US011713649B2

(12) United States Patent
Brandsdal et al.

(10) Patent No.: US 11,713,649 B2
(45) **Date of Patent: *Aug. 1, 2023**

(54) PLUGGING DEVICE

(71) Applicant: Nine Downhole Technologies, LLC, Houston, TX (US)

(72) Inventors: Viggo Brandsdal, Ytre Arna (NO); Geir Valestrand Aasheim, Ytre Arna (NO)

(73) Assignee: Nine Downhole Technologies, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/504,294

(22) Filed: Oct. 18, 2021

(65) Prior Publication Data

US 2022/0034194 A1 Feb. 3, 2022

Related U.S. Application Data

(63) Continuation of application No. 16/796,769, filed on Feb. 20, 2020, now Pat. No. 11,149,522.

(51) Int. Cl.
*E21B 34/06* (2006.01)
*E21B 33/12* (2006.01)

(52) U.S. Cl.
CPC ..... *E21B 34/063* (2013.01); *E21B 33/1208* (2013.01)

(58) Field of Classification Search
CPC ..... E21B 34/063; E21B 33/1208
See application file for complete search history.

(56) References Cited

U.S. PATENT DOCUMENTS

| | | | |
|---|---|---|---|
| 1,884,165 | A | 10/1932 | Otis |
| 2,565,731 | A | 4/1951 | Johnston |
| 2,756,828 | A | 7/1954 | Deily |
| 3,599,713 | A | 8/1971 | Jenkins |
| 3,831,680 | A | 8/1974 | Edwards et al. |

(Continued)

FOREIGN PATENT DOCUMENTS

| | | | |
|---|---|---|---|
| CA | 2469251 | A1 | 7/2003 |
| CA | 2670218 | A1 | 12/2010 |

(Continued)

OTHER PUBLICATIONS

Frank Allen et al., Extended-Reach Drilling: Breaking the 10-km Barrier (BP Exploration Operation Co. Ltd. 1997) at 46-47.

(Continued)

*Primary Examiner* — James G Sayre
(74) *Attorney, Agent, or Firm* — Vinson & Elkins L.L.P.

(57) ABSTRACT

A barrier plug assembly for sealing a subterranean wellbore is located inside a tubing and can comprise a frangible barrier element stacked on a carrier ring, a locking sleeve located above the carrier ring and located in a closed fluid chamber, a valve located on the closed fluid chamber and in pressure communication with the tubing, a retaining device configured for locking the a carrier ring in place, a crushing element located a distance below the frangible barrier element and configured for crushing the frangible barrier element. The valve can be configured for allowing or preventing fluid communication in between the tubing and the fluid chamber.

20 Claims, 7 Drawing Sheets

(56) References Cited

U.S. PATENT DOCUMENTS

| | | | |
|---|---|---|---|
| 4,512,491 | A | 4/1985 | DeGood et al. |
| 4,553,559 | A | 11/1985 | Short |
| 4,658,902 | A | 4/1987 | Wesson et al. |
| 4,664,184 | A | 5/1987 | Grigar |
| 4,691,775 | A | 9/1987 | Lustig et al. |
| 4,813,481 | A | 3/1989 | Sproul et al. |
| 5,050,630 | A | 9/1991 | Farwell et al. |
| 5,117,915 | A | 6/1992 | Mueller et al. |
| 5,188,182 | A | 2/1993 | Echols et al. |
| 5,479,986 | A | 1/1996 | Gano et al. |
| 5,511,617 | A | 4/1996 | Snider et al. |
| 5,685,372 | A | 11/1997 | Gano |
| 5,829,526 | A | 11/1998 | Rogers et al. |
| 5,924,696 | A | 7/1999 | Frazier |
| 5,996,696 | A | 12/1999 | Jeffree et al. |
| 6,334,488 | B1 | 1/2002 | Freiheit |
| 6,397,950 | B1 | 6/2002 | Streich et al. |
| 6,472,068 | B1 | 10/2002 | Glass et al. |
| 6,561,275 | B2 | 5/2003 | Glass et al. |
| 6,634,430 | B2 | 10/2003 | Dawson et al. |
| 6,672,389 | B1 | 1/2004 | Hinrichs |
| 7,117,946 | B2 | 10/2006 | Herr |
| 7,287,596 | B2 | 10/2007 | Frazier et al. |
| 7,455,116 | B2 | 11/2008 | Lembcke et al. |
| 7,513,311 | B2 | 4/2009 | Gramstad et al. |
| 7,624,796 | B2 | 12/2009 | Hassel-Sorensen |
| 7,661,480 | B2 | 2/2010 | Al-Anazi |
| 7,673,689 | B2 | 3/2010 | Jackson et al. |
| 7,708,066 | B2 | 5/2010 | Frazier |
| 7,789,162 | B2 | 9/2010 | Keller et al. |
| 7,950,409 | B2 | 5/2011 | Stokes et al. |
| 7,963,340 | B2 | 6/2011 | Gramstad et al. |
| 7,963,342 | B2 | 6/2011 | George |
| 8,813,848 | B2 | 8/2014 | Frazier |
| 8,820,437 | B2 | 9/2014 | Ervin et al. |
| 9,194,209 | B2 | 11/2015 | Frazier |
| 9,624,750 | B2 | 4/2017 | Entchev et al. |
| 11,149,522 | B2 * | 10/2021 | Brandsdal ..... E21B 34/063 |
| 2003/0168214 | A1 | 9/2003 | Sollesnes |
| 2007/0012438 | A1 | 1/2007 | Hassel-Sorensen |
| 2009/0020290 | A1 | 1/2009 | Ross et al. |
| 2009/0056955 | A1 | 3/2009 | Slack |
| 2014/0008085 | A1 * | 1/2014 | Tinnen ..... E21B 33/134 166/134 |
| 2016/0060998 | A1 * | 3/2016 | Hiorth ..... E21B 33/12 166/192 |
| 2017/0022783 | A1 * | 1/2017 | Yong ..... E21B 34/10 |
| 2018/0245421 | A1 | 8/2018 | Brandsdal |

FOREIGN PATENT DOCUMENTS

| | | | |
|---|---|---|---|
| WO | 1991012451 | A1 | 8/1991 |
| WO | 2003052239 | A1 | 6/2003 |
| WO | 2009116871 | A1 | 9/2009 |

OTHER PUBLICATIONS

Oil and Gas Online, Single MagnumDisk™ (Jun. 21, 2011).

Owen Oil Tools, Magnum Ported Underbalance Sub (Core Lab Sep. 2012), at 1-2.

Owen Oil Tools, Surge Tool, Underbalance Sub (Core Lab Jun. 2002), at 1-3.

Rogers et al., Buoyancy Technology Used Effectively in Casing Running Operations to Extend Lateral Stepout, SPE/IADC 148541 (Oct. 24, 2011), at 2-3, 11; Fig 13.

Shaker et al., Implementation of New Technologies for Oil and Gas Industry, SPE 88738 (Oct. 2004), at 1, 3, 5-6.

Farrar, Chilien M., U.S. Pat. No. 244,042 entitled "Check for Oil Well Tubes," dated Jul. 12, 1881.

* cited by examiner

PLUGGING DEVICE

CROSS-REFERENCE TO RELATED APPLICATION

This application is a Continuation of U.S. application Ser. No. 16/796,769, filed Feb. 20, 2020, entitled "PLUGGING DEVICE," issued as U.S. Pat. No. 11,149,522 on Oct. 19, 2021, which is hereby incorporated by reference as if fully set forth herein.

TECHNICAL FIELD

The present invention relates to a holding and crushing device for a plugging device in hydrocarbon wells, the plug comprising a barrier material of frangible material.

BACKGROUND

Existing barrier plugs and similar devices are brought into an open state by a mechanical or hydraulic translation of an activation signal and/or force from the upper side of the plug to the lower side of the plug. This mechanical or hydraulic translation takes place though a channel or bore that bypasses the sealing devices of the plug. Such configurations comprise many parts and potential points of failure, in the form of sleeves, seals, rings etc. Also, configurations based on bypass channels and bores are inherently vulnerable, since they provide potential paths of fluid loss, pressure drops, and other forms of leakage. In addition, such complicated and vulnerable plug arrangements are dependent on tight tolerances and movement of several parts.

In order to reduce or eliminate the above mentioned disadvantages of known techniques, there is a need for an improved plug arrangement comprising a frangible barrier material. Particularly, there is a need for a plug arrangement comprising an improved actuation mechanism for bringing the plug arrangement into an open state. While some embodiments of the present invention are applicable to barrier plugs, the same mechanisms described herein are also useful in other applications in hydrocarbon wells where a plugging device is needed to separate two regions.

It is an objective of the present invention to meet this need and to provide further advantages over the state of the art.

SUMMARY

It is an object of the present invention to mitigate, alleviate or eliminate one or more of the above-identified deficiencies and disadvantages in the prior art and solve at least the above mentioned problems.

Aspects of the present invention relate to a disappearing barrier plug assembly for sealing a subterranean wellbore, the disappearing barrier plug assembly comprising: a tubular housing having a topside end and a down-hole end, and having a fluid passageway therethrough; a frangible barrier element disposed in the fluid passageway, such that fluid cannot flow through the fluid passageway while the frangible barrier element is disposed in the fluid passageway, the frangible barrier element disposed on a carrier ring, and comprised of a material that, when subjected to a concentrated force, will break; a locking sleeve arranged above the carrier ring in the direction of the topside end of the tubular housing, and located in a closed fluid chamber; and a retaining device configured to lock the carrier ring in place.

In some embodiments, the barrier plug further comprises a valve arranged on the closed fluid chamber and in pressure communication with the topside pressure, the valve configured to allow or prevent pressure communication between a topside pressure and the fluid chamber. In some embodiments, the valve is in fluid communication with the fluid passageway and the fluid chamber. In some embodiments, the valve comprises a burst disk. In some embodiments, the barrier plug further comprises a crushing element arranged a distance from the frangible barrier element and configured for crushing the at least one frangible barrier element. In some embodiments, the crushing element is arranged a distance in a downhole direction from the frangible barrier element. In some embodiments, one or more first sealing elements are arranged on an outer surface of the disappearing barrier plug assembly for sealing an annulus defined between the barrier plug assembly and a tubular enclosure in which the barrier plug is placed. In some embodiments, one or more second sealing elements defines the closed fluid chamber. In some embodiments, the locking sleeve comprises a first cavity for receiving an element of the retaining device. In some embodiments, the tubular housing comprises a second cavity for receiving an element of the retaining device, wherein the second cavity has a volume greater than the first cavity. In some embodiments, the retaining device is arranged inside the second cavity.

Aspects of the present invention also relate to a disappearing barrier plug assembly for sealing a subterranean wellbore, the disappearing barrier plug assembly comprising: at least one frangible barrier element stacked on an axially moveable carrier ring prevented from moving by a retaining device arranged in a second cavity defined by a tubular housing; an axially moveable locking sleeve arranged above the carrier ring and located inside a closed fluid chamber comprising a valve having a predetermined opening pressure that when exceeded the valve allows pressure from tubing into the fluid chamber, wherein the locking sleeve comprises a first cavity that, when aligned with the second cavity, the retaining device is released from the second cavity whereby the axially moveable carrier ring and the at least one frangible barrier element are permitted to move towards a crushing element arranged below the one frangible barrier element and configured to disintegrate the at least one frangible barrier element.

In some embodiments, the one or more first sealing elements arranged on an outer surface of the disappearing barrier plug assembly for sealing an annulus defined between the disappearing barrier plug assembly and the tubing. In some embodiments, one or more second sealing elements defines the fluid chamber. In some embodiments, the axially moveable locking sleeve is a piston.

Aspects of the present invention also relate to a method for opening a disappearing barrier plug assembly for sealing a subterranean wellbore, the method comprising: providing a disappearing barrier plug assembly comprising a tubular housing having a topside end and a down-hole end, and having a fluid passageway therethrough; a frangible barrier element disposed in the fluid passageway, such that fluid cannot flow through the fluid passageway while the frangible barrier element is disposed in the fluid passageway, the frangible barrier element disposed on a carrier ring, and comprised of a material that, when subjected to a concentrated force, will break; a locking sleeve arranged above the carrier ring in the direction of the topside end of the tubular housing, and located in a closed fluid chamber; and a retaining device configured to lock the carrier ring in place, creating an opening in the closed fluid chamber, applying a topside pressure to the tubular housing that passes into the closed fluid chamber, moving the locking sleeve into an open position that releases the retaining device, causing the frangible barrier element to move.

In some embodiments, the step of applying a topside pressure comprises opening a valve arranged on the closed fluid chamber and in pressure communication with the tubing, the valve configured to allow or prevent pressure communication between the tubing and the fluid chamber. In some embodiments, the method further comprises the step of causing the frangible barrier element to contact a crushing element thereby breaking the frangible barrier element. In some embodiments, the locking sleeve comprises a first cavity which contains an element of the retaining device. In some embodiments, releasing the retaining device further comprises moving an element of the retaining device from the first cavity in the locking sleeve to a second cavity in the tubular housing.

The present invention will become apparent from the detailed description given below.

BRIEF DESCRIPTION OF THE FIGURES

Included in the present specification are figures which illustrate various embodiments of the present disclosed technology. As will be recognized by a person of ordinary skill in the art, actual embodiments of the disclosed technology need not incorporate each and every component illustrated, but may omit components, add additional components, or change the general order and placement of components. Reference will now be made to the accompanying figures and flow diagrams, which are not necessarily drawn to scale, where like numerals denote common features between the drawings, and wherein.

DETAILED DESCRIPTION

Figure 1:
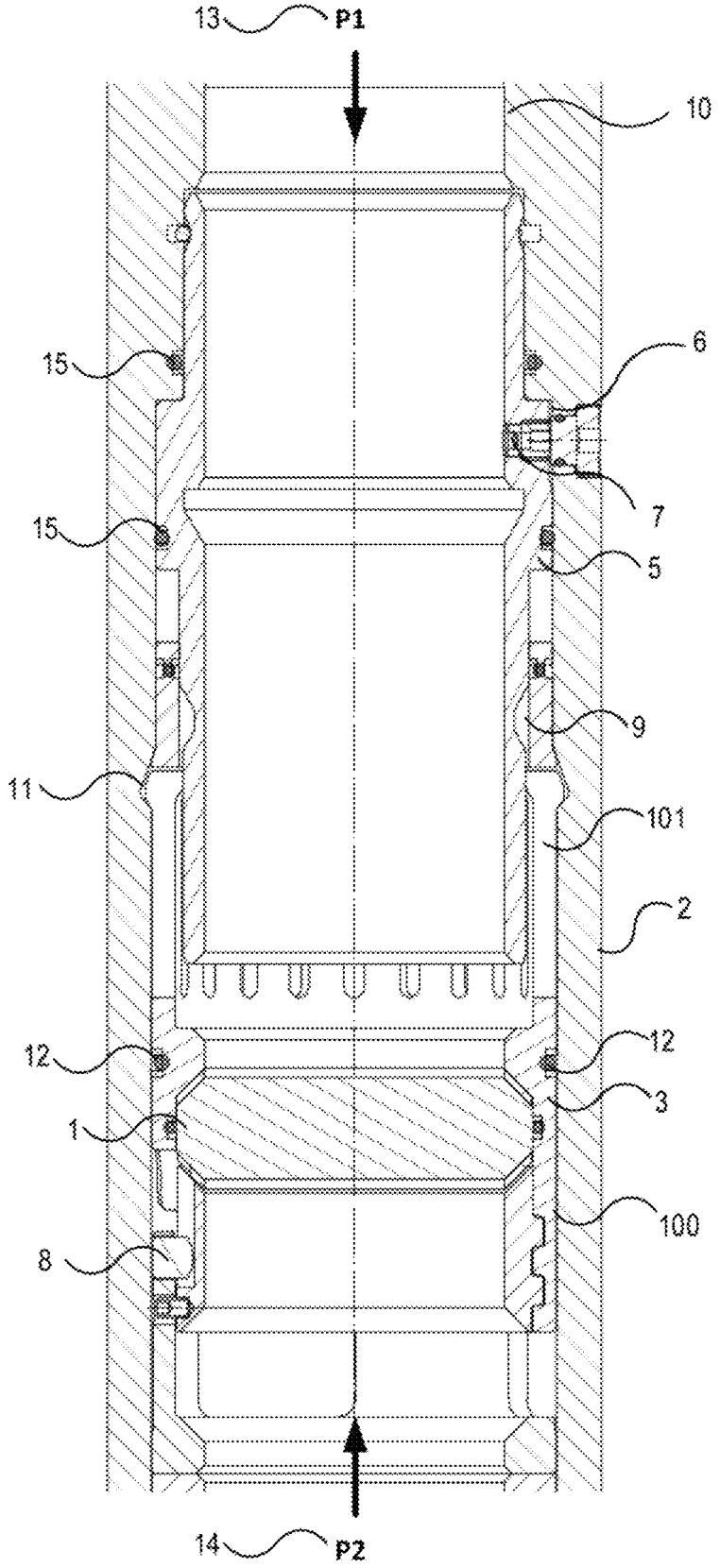
FIG. 1 shows a section view of a barrier plug having a split fingers locking device in accordance with the disclosure in a closed and locked state.

The present invention will now be described with reference to the accompanying drawings, in which preferred example embodiments of the invention are shown. The invention may, however, be embodied in other forms and should not be construed as limited to the herein disclosed embodiments. The disclosed embodiments are provided to fully convey the scope of the invention to the skilled person. Although example embodiments of the present disclosure are explained in detail, it is to be understood that other embodiments are contemplated. Accordingly, it is not intended that the present disclosure be limited in its scope to the details of construction and arrangement of components set forth in the following description or illustrated in the drawings. The present disclosure is capable of other embodiments and of being practiced or carried out in various ways.

It must also be noted that, as used in the specification and the appended claims, the singular forms "a," "an" and "the" include plural referents unless the context clearly dictates otherwise. Moreover, titles or subtitles may be used in this specification for the convenience of a reader, which have no influence on the scope of the present disclosure.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

In describing example embodiments, terminology will be resorted to for the sake of clarity. It is intended that each term contemplates its broadest meaning as understood by those skilled in the art and includes all technical equivalents that operate in a similar manner to accomplish a similar purpose.

In the following detailed description, references are made to the accompanying drawings that form a part hereof and that show, by way of illustration, specific embodiments or examples. In referring to the drawings, like numerals represent like elements throughout the several figures.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

FIG. 1 illustrates a barrier plug assembly 100 in accordance with an embodiment. Barrier plug assembly 100 can be arranged inside a housing 10 in a tubing 2. The barrier plug assembly 100 can comprise at least one barrier element 1 that may be stacked onto a moveable carrier ring 3. In some embodiments, barrier element 1 can comprise glass. In other embodiments, barrier element 1 can comprise other frangible materials, such as ceramic, hard polymer, or other material that can break (e.g., fracture or shatter) when a concentrated force is applied. In some embodiments, the moveable carrier ring 3 can be locked in place by means of a retaining device 101 and a locking sleeve 5. In some embodiments, the locking sleeve 5 can comprise a first cavity 9. In some embodiments, the retaining device 101 may be arranged inside a second cavity 11 located on the housing 10. In some embodiments, the barrier plug assembly 100 can further comprise a fluid chamber 6 and a valve 7 configured for allowing or preventing pressure communication in between the housing 10 and the fluid chamber 6. In some embodiments, the valve 7 can be located on the outside of tubing 2 and in fluid communication with fluid in the annulus between the tubing 2 and the wellbore wall, and configured for allowing or preventing pressure communication between the annulus and the fluid chamber 6. In some embodiments, the carrier ring 3 and/or locking sleeve 5 can be secured to each other or the tubing 2 using a shear rings, balls, spheres, locking dogs, shear pins, and/or c-clips.

In some embodiments, the barrier plug assembly 100 can comprise a breaking, crushing, or shattering element 8 configured for crushing the at least one frangible barrier element 1. In some embodiments, the crushing element 8 can be any element configured to apply a force to the frangible barrier element 1 sufficient to initiate a fracture in the frangible barrier element 1. In some embodiments, the crushing element 8 can be a device similar in configuration to the carrier ring 3, but with a slightly different geometry to induce a load in the frangible barrier element to initiate a fracture. In some embodiments, the crushing element 8 can be located in the downhole direction from the frangible barrier element 1, where the carrier ring is configured to move in a downhole direction when the locking sleeve 5 is released. In some embodiments, the crushing element 8 can be located in a topside direction from the frangible barrier element 1, when the carrier ring 3 is configured to move in a topside direction when the locking sleeve 5 is released. Embodiments of the present invention also include embodiments having multiple crushing elements, located in a topside direction, downhole direction, or both, from the frangible barrier element 1.

In some embodiments, the barrier plug assembly 100 can comprise one or more first sealing elements 12 arranged on the outer surface of the barrier plug assembly 100 for sealing an annulus defined between the barrier plug assembly 100 and the tubing 2. In some embodiments, the barrier plug assembly 100 can comprise one or more second sealing elements 15 that can define the fluid chamber 6. In some embodiments, the one or more second sealing elements 15 can be configured to prevent pressure/fluid leakage between the fluid chamber 6 and the rest of the barrier plug assembly 100.

FIG. 1 shows that the barrier plug assembly 100 that is subject to a pressure region P1 13 at the top the barrier plug assembly 100 and a pressure region P2 14 below the barrier plug assembly 100. Pressure region P1 13, applied from an uphole side of the barrier plug assembly 100, can be referred as "topside pressure" and the pressure region P2 14, applied from a downhole side of the barrier plug assembly 100 can be referred to as "formation side pressure." In some embodiments, the barrier plug assembly 100 can be pre-installed in the tubing 2 before the tubing 2 in lowered in a subsurface wellbore (not shown) or may be installed in the tubing 2 after the tubing 2 is installed in the subsurface wellbore. In some embodiments, the subsurface wellbore is sealed after the barrier plug assembly 100 is installed in the tubing 2. The is no fluid communication in the wellbore between the region P1 13 above the barrier plug assembly 100 and the region P2 14 below the barrier plug assembly 100. To allow fluid communication between the regions P1 13 and P2 14, the operator must break the at least one frangible barrier element 1 of the barrier plug assembly 100.

In order to open the barrier plug assembly 100, the topside pressure region P1 13 in the tubing 2 may be increased to a value higher than a predetermined opening pressure of the valve 7. The valve 7 may be a burst disc, acoustic or magnetic operated valve systems, or similar. After the predetermined opening pressure of the valve 7 is exceeded, or the conditions for opening valve 7 are met, the valve 7 opens to allow fluid/pressure communication from region P1 13 into the fluid chamber 6. Pressure in the fluid chamber 6 increases and causes the locking sleeve 5 to move. The locking sleeve 5 may be a piston arranged inside the fluid chamber 6 and may be configured to move as a result of pressure change in the fluid chamber 6, either in an uphole direction, or a downhole direction. The fluid chamber 6 may be an empty chamber or may be filled with a low pressure fluid. In some embodiments, the locking sleeve 5 can be moved or unlocked using a mechanical wireline connection attached to the locking sleeve 5.

The locking sleeve 5 can comprise a first recess or a first cavity 9. In some embodiments, first cavity 9 can have a volume equal to or larger than the second recess or second cavity 11 of the tubular housing 10. In some embodiments, the locking sleeve 5 does not have a first recess or first cavity 9, such as, for example, in embodiments where the locking sleeve 5 moves in an uphole direction in response to a pressure change in fluid chamber 6. In such embodiments, the movement of the locking sleeve 5 in an uphole direction can allow the retaining device 101 to disengage from the second cavity 11 when the locking sleeve 5 moves past the second cavity 11. In other embodiments, the pressure region P1 13 can be increased until the first cavity 9 of the locking sleeve 5 aligns with the second cavity 11 of the tubular housing 10. When the first cavity 9 is aligned with the second cavity 11, the retaining device 101 is released from the second cavity 11 and into the first cavity 9 of the locking sleeve 5.

In some embodiments, when the locking sleeve 5 has moved a sufficient distance (either uphole or downhole) to release the retaining device 101, the retaining device 101 is no longer able to lock the carrier ring 3 in place. Therefore, the carrier ring 3, together with the frangible barrier element 1, moves towards the crushing element 8 which causes the frangible barrier element 1 to break. In some embodiments, where region P1 13 is greater than pressure region P2 14, the frangible barrier element 1 can move in a downhole direction toward a crushing element 8 located downhole from the frangible barrier element 1. In some embodiments, where pressure region P2 14 is greater than pressure region P1 13, the frangible barrier element 1 can move in a topside direction towards a crushing element 8 located in a topside direction from the frangible barrier element 1.

Figure 4:
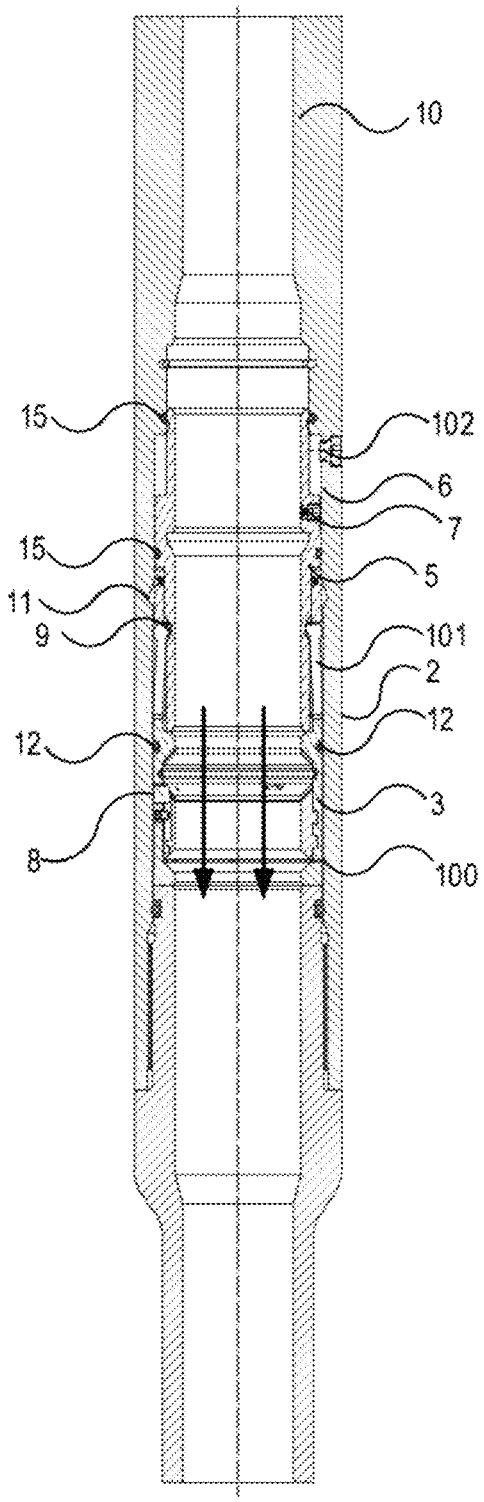
FIG. 4 shows a section view of the barrier plug of FIG. 1 after the frangible barrier element has been shattered, allowing fluid flow through the barrier plug.
Figure 5:
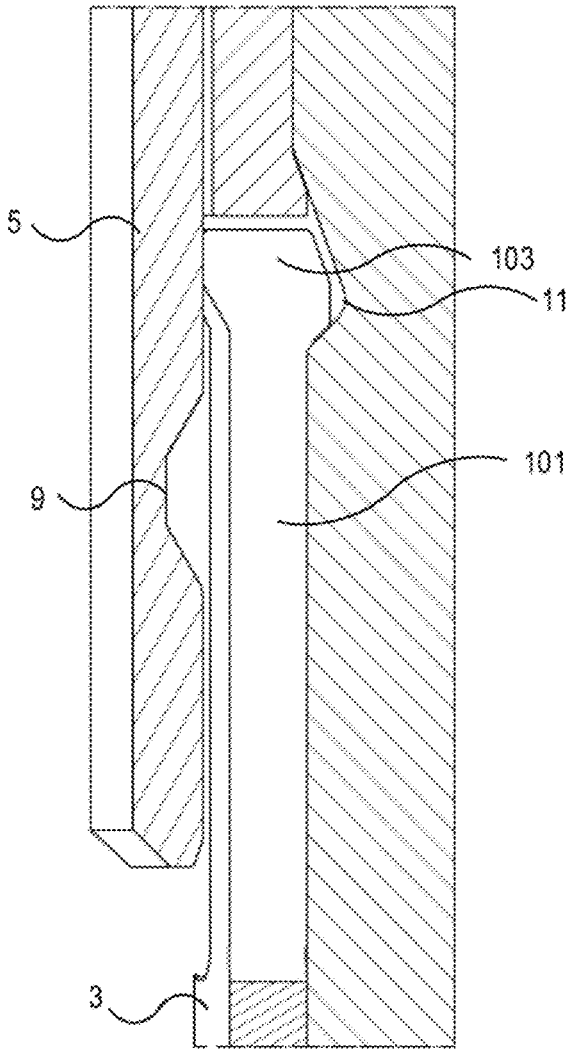
FIG. 5 shows a detailed view of a split finger locking device in accordance with the disclosure.

The movement of the carrier ring 3 towards the crushing element 8 can be caused by the release of the retaining device 101 and the pressure difference between the topside pressure region P1 13 and the formation side pressure region P2 14. The topside pressure region P1 13 should be increased higher than the formation side pressure region P2 14 to allow the movement of the carrier ring 3 towards the crushing element 8. In some embodiments, the crushing element 8 can be studs, spikes, knives or surfaces that are capable of penetrating through the at least one frangible barrier element or causing the frangible barrier element 1 to shatter into small pieces. FIG. 4 depicts a barrier plug assembly 100 after the frangible barrier element 1 has been shattered, depicting a barrier plug assembly 100 that allows fluid to flow through the carrier ring 3. The barrier plug assembly 100 can comprise more than more one retaining device 101 and the locking sleeve 5 and the tubular housing 10 may comprise more than one recess that fit more than one retaining device.

Figure 2:
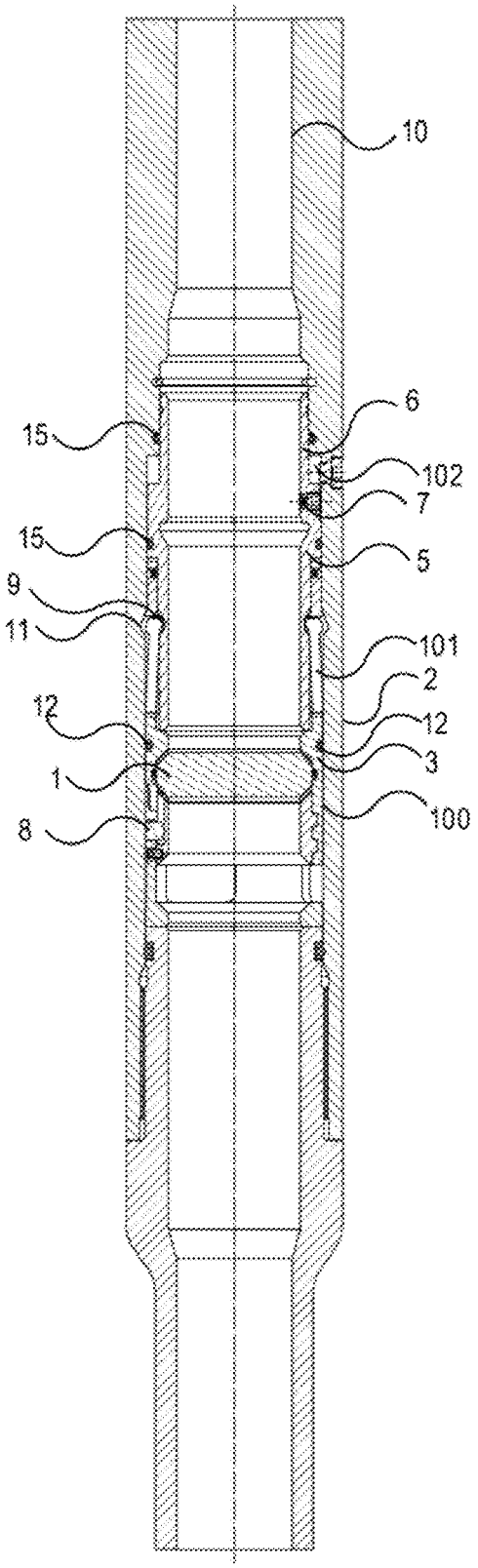
FIG. 2 shows a section view of the barrier plug of FIG. 1 in a closed but unlocked state.
Figure 3:
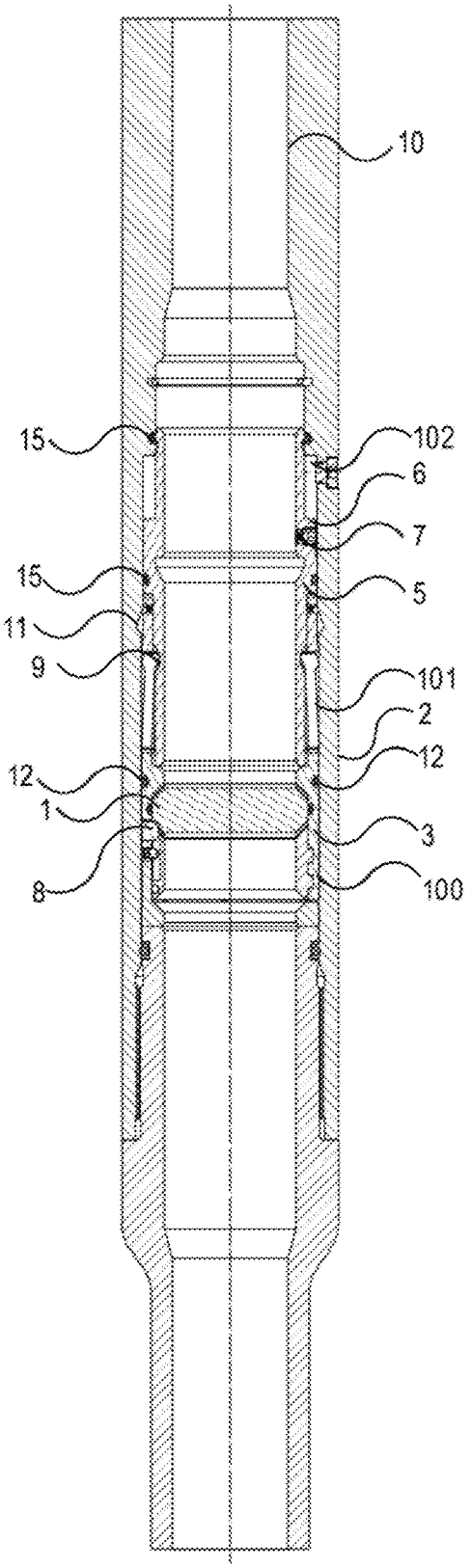
FIG. 3 shows a section view of the barrier plug of FIG. 1 in an open state.

In some embodiments, the retaining device 101 can be one or more split fingers attached to, or cut into to carrier ring 3. For example, FIG. 1 depicts an embodiment where retaining device 101 is a "finger" connected to carrier ring 3. The finger 101 has an upper portion 103 that is shaped such that, when the barrier plug assembly 100 is in a closed and locked position, a part of the upper portion 103 fits in second cavity 11, securing the carrier ring 3 in place (see FIG. 1. As depicted in FIG. 2, when the first cavity 9 of the locking ring 5 is moved to align with the second cavity 11, the finger 101 can flex around its connection to carrier ring 5, and move into the first cavity 9, unlocking carrier ring 3. As depicted in FIG. 3, once the finger is disposed in first cavity 9 of locking ring 5, the carrier ring 3 is free to slide in a downhole direction, moving the frangible barrier element 1 to crushing element 8.

Figure 6:
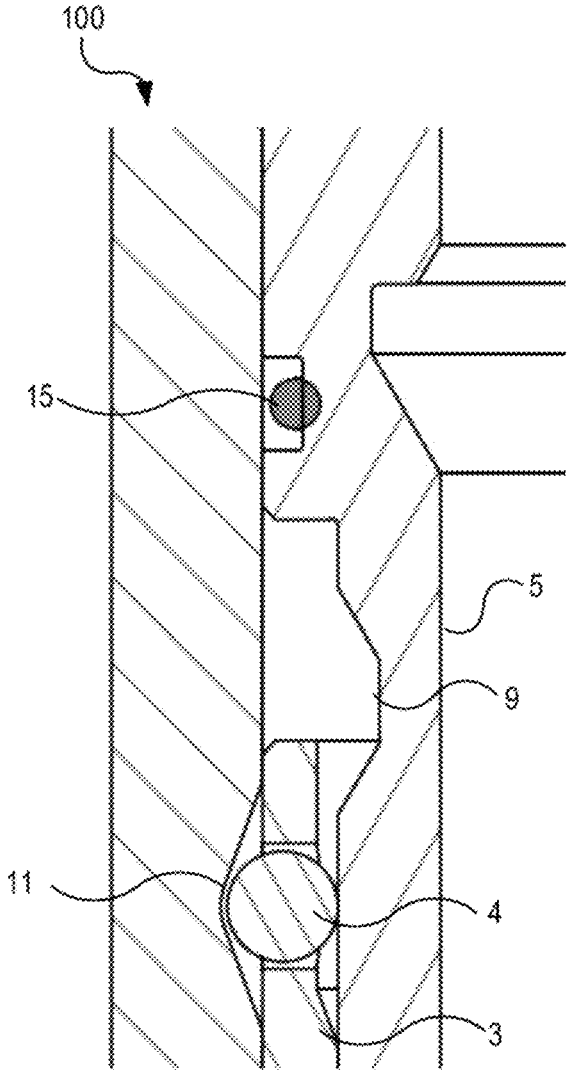
FIG. 6 shows a section view of an embodiment in accordance with the disclosure in a closed and locked state.
Figure 7:
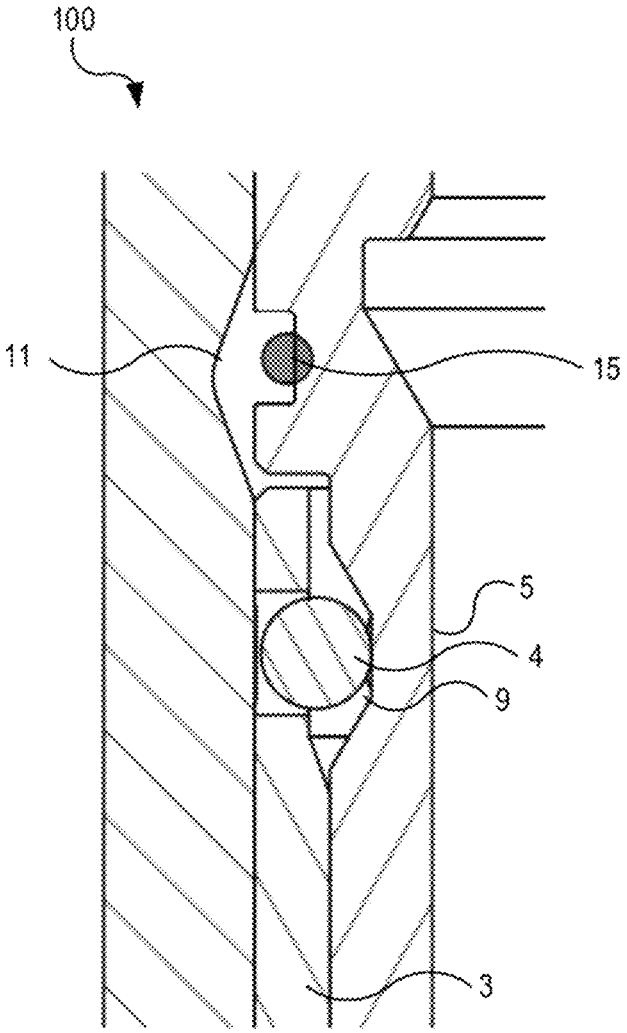
FIG. 7 shows a section view of an embodiment in accordance with the disclosure in an opened state.

In some embodiments, the retaining device can be a ball 4 or a similar object. FIG. 6 and FIG. 7 depict another embodiment of a barrier plug assembly 100 using a ball 4 as a retaining device. The details not shown of the embodiment depicted in FIG. 7 are substantially the same as those shown in FIGS. 1-4. In the locked position in FIG. 6, the ball 4 is disposed in second cavity 11, securing the carrier ring 3 in place. As depicted in FIG. 7, when the locking sleeve 5 is moved to align first cavity 9 with second cavity 11, the ball moves into first cavity 9, unlocking the carrier ring 3. In some embodiments, the ball 4 can be sheared apart to unlock the carrier ring due to a shear force applied by locking sleeve 5. Once the ball 4 has moved into the second cavity 11, the carrier ring 3 is free to move in a downhole direction. As with the embodiment shown in FIG. 3, the carrier ring 3 moves the frangible barrier element 1 in a downhole direction until it contacts crushing element 8, shattering the frangible barrier element 1, and allowing fluid to pass through the barrier plug assembly 100. In some embodiments, the locking sleeve 5, the retaining device 101, 4 and carrier ring 3 can all located above the at least one frangible barrier element 1. Having a releasable sleeve that is arranged below the barrier element 1 means that a passage that extends between the topside of the barrier plug assembly 100 (surface side) and the bottom side of the barrier plug assembly 100 (formation side) is needed.

The person skilled in the art realizes that the present invention is not limited to the preferred embodiments described above. The person skilled in the art further realizes that modifications and variations are possible within the scope of the appended claims. Additionally, variations to the disclosed embodiments can be understood and effected by the skilled person in practicing the claimed invention, from a study of the drawings, the disclosure, and the appended claims.

The invention claimed is:

1. A barrier plug assembly for sealing a subterranean wellbore, the barrier plug assembly comprising:

a tubular housing having a topside end and a down-hole end, and having a fluid passageway through the tubular housing;

a frangible barrier element disposed in the fluid passageway, such that fluid cannot flow through the fluid passageway when the frangible barrier element is disposed in the fluid passageway, wherein the frangible harrier element is mounted on a carrier ring and is comprised of a frangible material that breaks when the frangible barrier element is subjected to a concentrated force;

a retaining device configured to lock the carrier ring in place when a locking sleeve is in a first position, and the retaining device configured to unlock the carrier ring when the locking sleeve is in a second position; and a valve enabled for fluid communication with a fluid chamber and further enabled for fluid communication with the topside end, the valve configured to allow or prevent fluid communication between the topside end and the fluid chamber wherein the fluid chamber is enclosed when the valve is closed.

2. The barrier plug assembly of claim 1, wherein the valve is enabled to provide fluid communication between the fluid passageway and the fluid chamber.

3. The barrier plug assembly of claim 1, wherein the tubular housing is configured to be connected to tubing, and wherein a minimum internal diameter of the fluid passageway through the tubular housing is equal to or greater than the internal diameter of the tubing.

4. The barrier plug assembly of claim 1, further comprising a crushing element initially located a distance apart from the frangible barrier element and configured to apply the concentrated force to the frangible barrier element when the crushing element comes into contact with the frangible barrier element.

5. The barrier plug assembly of claim 4, wherein the distance is in a downhole direction apart from the frangible barrier element.

6. The barrier plug assembly of claim 1, further comprising one or more first sealing elements that are located on an outer surface of the barrier plug assembly for sealing between the barrier plug assembly and the tubular housing.

7. The barrier plug assembly of claim 1, further comprising one or more second sealing elements that seal the fluid chamber.

8. The barrier plug assembly of claim 1, where in the locking sleeve comprises a first cavity for receiving a portion of the retaining device.

9. The barrier plug assembly of claim 8, wherein the tubular housing comprises a second cavity for receiving the portion of the retaining device, wherein the second cavity has a volume less than or equal to the first cavity.

10. The barrier plug assembly of claim 9, wherein the portion of the retaining device is initially located at least partially within the second cavity.

11. A barrier plug assembly for sealing a subterranean wellbore, the barrier plug assembly comprising:

at least one frangible barrier element stacked on a carrier ring, wherein the carrier ring is enabled for axial movement and is configured to be prevented from the axial movement when a retaining device is located in a second cavity located in a tubular housing enclosing the barrier plug assembly;

the locking sleeve comprising a valve enabled for fluid communication between a tubular housing and a fluid chamber, wherein the locking sleeve comprises a first cavity that is enabled for axial alignment with the second cavity when the locking sleeve is displaced in the tubular housing in response to a predetermined pressure in the tubular housing being exceeded to open the valve and allow the fluid communication; and wherein when the second cavity is axially aligned with the first cavity, the retaining device at least partially occupies the first cavity such that the carrier ring and the at least one frangible barrier element move towards a crushing element located adjacent the one frangible barrier element, the crushing element configured to disintegrate the at least one frangible barrier element upon contact with the at least one frangible barrier element.

12. The barrier plug assembly of claim 11, further comprising one or more first sealing elements located on an outer surface of the barrier plug assembly for sealing between the barrier plug assembly and the tubular housing.

13. The barrier plug assembly of claim 11, further comprising one or more second sealing elements that seal the fluid chamber.

14. The barrier plug assembly of claim 11, wherein the locking sleeve is a piston.

15. A method for opening a barrier plug assembly for sealing a subterranean wellbore, the method comprising:

positioning a barrier plug assembly in a subterranean wellbore, the barrier plug assembly comprising:

a tubular housing having a topside end and a down-hole end, and having a fluid passageway through the tubular housing;

a frangible barrier element disposed in the fluid passageway, such that fluid cannot flow through the fluid passageway when the frangible barrier element is intact in the fluid passageway, the frangible barrier element mounted on a carrier ring and comprised of a frangible material that breaks, when subjected to a concentrated force; and a retaining device configured to lock the carrier ring in place when a locking sleeve is in a first position and the retaining device configured to unlock the carrier ring when the locking sleeve is in a second position;

when the locking sleeve is in the first position, applying a topside pressure to the tubular housing, wherein a fluid chamber in the locking sleeve that is closed prior to the applying the topside pressure is opened to fluid communication with the tubular housing; and responsive to the topside pressure being applied to the fluid chamber, causing the locking sleeve to move into the second position, wherein the retaining device unlocks the carrier ring and causes the frangible barrier element to move.

16. The method of claim 15, wherein the applying the topside pressure further comprises opening a valve located at the fluid chamber and in fluid communication with the tubular housing, the valve configured to allow or prevent fluid communication between the tubular housing and the fluid chamber.

17. The method of claim 15, further comprising causing the frangible barrier element to contact a crushing element that applies the concentrated force to the frangible barrier element, wherein the frangible barrier element is broken.

18. The method of claim 15, wherein the locking sleeve comprises a first cavity for receiving an element of the retaining device.

19. The method of claim 18, wherein causing the locking sleeve to move into the second position further comprises;

causing the element of the retaining device to move from at least partially occupying a second cavity in the tubular housing to at least partially occupying the first cavity in the locking sleeve.

20. The method of claim 15, wherein the causing the locking sleeve to move into the second position further comprises causing the locking sleeve to move in an uphole direction.

* * * * *